US007394012B2

(12) United States Patent
Schultz

(10) Patent No.: US 7,394,012 B2
(45) Date of Patent: Jul. 1, 2008

(54) WIND INSTRUMENT PHONE

(75) Inventor: Charles P. Schultz, North Miami Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/466,712

(22) Filed: Aug. 23, 2006

(65) Prior Publication Data

US 2008/0047415 A1 Feb. 28, 2008

(51) Int. Cl.
*G10H 1/00* (2006.01)

(52) U.S. Cl. ..... 84/615; 84/653; 84/719; 84/644; 84/744

(58) Field of Classification Search ..... 84/615, 84/653, 719, 644, 744
See application file for complete search history.

(56) References Cited

U.S. PATENT DOCUMENTS

| | | | | |
|---|---|---|---|---|
| 5,170,003 | A * | 12/1992 | Kawashima | 84/619 |
| 5,922,985 | A * | 7/1999 | Taniwaki | 84/742 |
| 6,740,802 | B1 * | 5/2004 | Browne, Jr. | 84/609 |
| 7,271,329 | B2 * | 9/2007 | Franzblau | 84/609 |
| 2005/0056139 | A1 * | 3/2005 | Sakurada | 84/616 |
| 2005/0076774 | A1 | 4/2005 | Sakurada | |
| 2005/0272475 | A1 * | 12/2005 | Hahn | 455/566 |
| 2006/0027080 | A1 | 2/2006 | Schultz | |
| 2007/0137467 | A1 * | 6/2007 | Sim et al. | 84/645 |

OTHER PUBLICATIONS

Ralph J. Jones, "Trumpet/Cornet Fingerings", Basic Trumpet Fingerings, 1998, 1 page, http://www.whc.net/rjones/trumpetfinger.html, web site last visited Aug. 23, 2006.

Ian Tindale, "Replace Buttons With Mouth Organ", Jan. 15, 2005, 1-2 pp., Halfbakery.com, http://www.halfbakery.com/idea/Replace_20Buttons_20With_20Mouth_20Organ, web site last visited Aug. 23, 2006.

The Wireless Authority - Wireless Week. Forget the Air Guitar - Use your Cell Phone for your Next Solo. Reed Business Information, A Division of Reed Elsevier Inc. www.wirelessweek.com - 2006.

* cited by examiner

*Primary Examiner*—David S. Warren

(57) ABSTRACT

A mobile device (160) and method (300) for generating wind instrument sounds is provided. The mobile device can include a microphone (102) for capturing an air turbulence in response to a blowing action, a keypad (104) for selecting a virtual valve to associate with the air turbulence, a synthesis engine (106) for synthesizing a musical note in response to the blowing and the virtual valve, and an audio speaker (108) for playing the musical note. One or more keys of the keypad can be depressed during the blowing action on the microphone for synthesizing a musical note of a wind instrument. A display (110) can present a musical notation (800) and a fingering chart (810) for musical notes.

20 Claims, 5 Drawing Sheets

400

| VALVE FINGER | KEYPAD KEY |
|---|---|
| 1 | 0 |
| 2 | 8 |
| 3 | 5 |
| 4* | 2 |

FIG. 4

500

| | INSTRUMENT 1 | INSTRUMENT 2 | INSTRUMENT 3 |
|---|---|---|---|
| VALVE FINGER | KEYPAD KEY | KEYPAD KEY | KEYPAD KEY |
| 1 | * | 0 | # |
| 2 | 7 | 8 | 9 |
| 3 | 4 | 5 | 6 |
| 4* | 1 | 2 | 3 |

104

FIG. 5

WIND INSTRUMENT PHONE

FIELD OF THE INVENTION

The present invention relates to mobile devices, and more particularly, to methods for using a mobile device as a musical instrument.

BACKGROUND

The use of portable electronic devices and mobile communication devices has increased dramatically in recent years. Mobile devices are capable of establishing communication with other communication devices over landline networks, cellular networks, and, recently, wide local area networks (WLANs). Mobile devices are capable of providing access to Internet services which are bringing people closer together in a world of information. Mobile devices operating over a telecommunications infrastructure are capable of providing various forms of multimedia and entertainment. People are able to collaborate on projects, discuss ideas, interact with one another on-line, all while communicating via text, audio, and video.

A mobile device such as a portable music player can be used to download songs, edit music files, compose music, and share music files. However, the music files or sound files are generally pre-recorded. For example, a downloaded song is generally recorded and produced in a studio or mixed at a production facility. The music is generally provided as a completed recording and allows only for limited types of editing. Moreover, the music is composed by musicians who have access to music equipment including musical instruments. Users are generally unable to create musical instrument sounds without access to a musical instrument.

SUMMARY

Embodiments of the invention are directed to a mobile device suitable for use as a wind instrument. The mobile device can include a microphone for capturing an air turbulence in response to a blowing action on the microphone, a keypad for selecting at least one virtual valve to associate with the air turbulence, a synthesis engine for synthesizing a musical note in response to the blowing based on the at least one virtual valve and the air turbulence, and an audio speaker for playing the musical note. One or more keys of the keypad can be depressed during the blowing action on the microphone for synthesizing a musical note of a wind instrument. The synthesis engine may be one of a Musical Instrument Device Interface (MIDI) synthesis engine that is Frequency Modulated (FM) generated or Waveform generated. In another arrangement, musical notes can be synthesized via acoustic modeling such as sampled waveforms, or mathematical modeling of sounds. Sampled waveforms can be extracted from portions of a WAV, OOG, or MP3 format digital media but are not herein limited to these.

The mobile device can include a detector for determining an acoustic pressure of the air turbulence, and a processor for mapping the acoustic pressure to a musical note. One or more keys of the keypad can be depressed for changing the musical note in accordance with the acoustic pressure. The processor can change the musical note as a function of the acoustic pressure, wherein the function is based on at least one threshold such that the at least one musical note changes if the acoustic pressure exceeds the at least one threshold. The detector can determine a duration of the air turbulence and the processor can hold the musical note for the duration. The mobile device can further include a display for presenting a musical notation of the musical note.

In one aspect, the musical notation can identify a numerical fingering of the at least one virtual valve corresponding to a key on the keypad. The keypad can include at least one back light element for illuminating a key that corresponds to a virtual valve. In one arrangement, the keypad provides a key to virtual valve mapping for three simultaneous instruments, wherein a first wind instrument employs at least one of keys *, 7, 4, or 1, a second wind instrument employs at least one of keys 0, 8, 5, 2, and a third wind instrument employs at least one of keys #, 9, 6, and 3.

Embodiments of the invention are also directed to a mobile device suitable for use as a training wind instrument. The mobile device can include a display for presenting a musical notation and numerical fingering of a musical note, a back light keypad for illuminating at least one key of the keypad to associate with the musical notation, a microphone for capturing an air turbulence in response to a blowing action on the microphone, a synthesis engine for producing a musical note in response to a pressing of an illuminated key and a blowing into the microphone, an audio speaker for playing the synthetic musical note, and a processor for mapping an acoustic pressure of the air turbulence to a musical note. An image of a wind instrument can be presented on the display, and the synthesis engine can generate a modeled sound of the displayed wind instrument. A processor can determine if the blowing action exceeds a threshold for producing a note of the musical notation, and can present a visual comparison of the musical note and the note for providing training feedback on breath control. In one arrangement, the microphone can determine a consistency of the blowing action based on an acoustic pressure of the air turbulence, and the display can present an indication of the consistency for informing a user of a breath control.

The mobile device can include a data store for storing musical notations to present on the display as training material, and a recording unit for saving musical note compositions produced in response to a playing of the mobile device as a wind instrument. The mobile device can include a mouthpiece attachment for associating an acoustic pressure of the blowing action to an illuminated key and determining a musical note for the mobile device to produce.

BRIEF DESCRIPTION OF THE DRAWINGS

The features of the system, which are believed to be novel, are set forth with particularity in the appended claims. The embodiments herein, can be understood by reference to the following description, taken in conjunction with the accompanying drawings, in the several figures of which like reference numerals identify like elements, and in which:

FIG. 4 is a key to valve mapping of the mobile device of FIG. 1 in accordance with the embodiments of the invention;

FIG. 5 is a key to valve mapping of the mobile device of FIG. 1 for three wind instruments in accordance with the embodiments of the invention;

DETAILED DESCRIPTION

Figure 1:
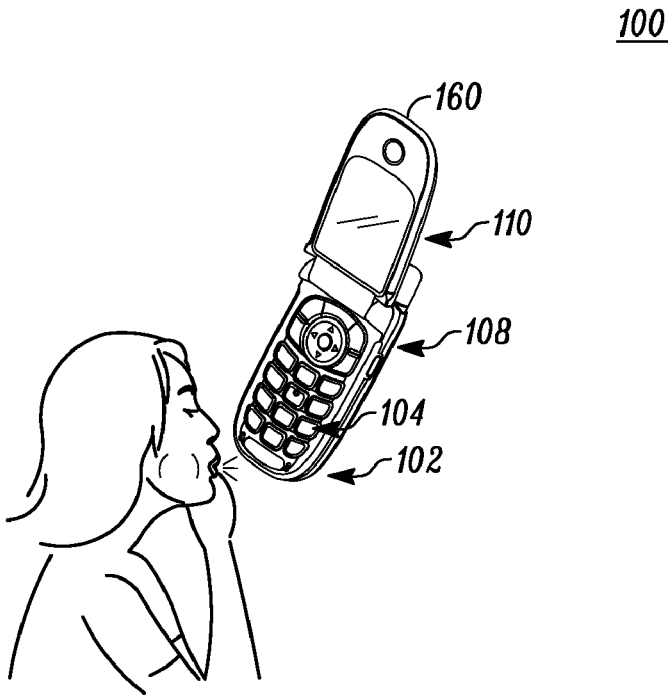
FIG. 1 is an illustration of a mobile device suitable for use as a wind instrument in accordance with the embodiments of the invention.

While the specification concludes with claims defining the features of the embodiments of the invention that are regarded as novel, it is believed that the method, system, and other embodiments will be better understood from a consideration of the following description in conjunction with the drawing figures, in which like reference numerals are carried forward.

As required, detailed embodiments of the present method and system are disclosed herein. However, it is to be understood that the disclosed embodiments are merely exemplary, which can be embodied in various forms. Therefore, specific structural and functional details disclosed herein are not to be interpreted as limiting, but merely as a basis for the claims and as a representative basis for teaching one skilled in the art to variously employ the embodiments of the present invention in virtually any appropriately detailed structure. Further, the terms and phrases used herein are not intended to be limiting but rather to provide an understandable description of the embodiment herein.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "processing" or "processor" can be defined as any number of suitable processors, controllers, units, or the like that are capable of carrying out a pre-programmed or programmed set of instructions. The terms "program," "software application," and the like as used herein, are defined as a sequence of instructions designed for execution on a computer system. A program, computer program, or software application may include a subroutine, a function, a procedure, an object method, an object implementation, an executable application, an applet, a midlet, a servlet, a source code, an object code, a shared library/dynamic load library and/or other sequence of instructions designed for execution on a computer system.

The term "synthetic sound" can be defined as sound generated by software or hardware. The term "emulate" can be defined as imitating a function of. The term "acoustic modeling" can be defined as the generating of an acoustic signal through modeling. The term "modeling" can be defined as producing a behavior based on a model. The term "synthesis" can be defined as generating or producing via mathematical algorithms or sampling algorithms. The term "synthesizing" can be defined as creating either from a mathematical model, an acoustic model, a sampled waveform, a frequency modulated waveform, or a musical instrument device interface (MIDI) instrument. The term "waveform modeling" can be defined as sampling a waveform and using a portion of the waveform to synthesize a sound. The term "mathematical modeling" can be defined as using mathematical methods to generate a replica of at least a portion of a waveform or a synthetic waveform. The term "mapping" can be defined as translating one form into another form. The term "valve" can be defined as an object that permits change in pitch by a rapid varying of an air column in a tube. The term "virtual valve" can be defined as an emulated valve. The term "pitch" can be defined as a signal having periodicity. The term "blowing" can mean to produce air turbulence for varying air. The term "air turbulence" can be defined as an eddying motion of air molecules. The term "pressure" can be defined as a force per unit area. The term "musical note" can be defined as a tone of definite pitch. The term "acoustic" can be defined as a signal that carries sound. The term "wind instrument" can be defined as an object that generates or emulates sound in response to a blowing of air through at least one tube. The term "tube" can be defined as a column providing a passage of air for generating turbulence and producing at least one sound.

Referring to FIG. 1, a mobile device 160 suitable for use as a wind instrument 100 is shown. The mobile device 160 may be a cell phone, a portable media player, a music player, a handheld game device, or any other suitable communication device. Briefly, a user can orient the mobile device 160 in a manner similar to a wind instrument, and use the mobile device 160 to produce wind instrument sounds. A user can blow into a microphone 102 of the mobile device and play the mobile device 160 as a wind instrument to produce various wind instrument sounds. For example, a user can emulate a trumpet, a tuba, a flugel horn, an oboe, a clarinet, a flute, or any other suitable wind instrument with the mobile device 160.

In one aspect, the mobile device can operate as a cell phone over a mobile communications network. For example, the mobile device 160 can provide wireless connectivity over a radio frequency (RF) communication link or a Wireless Local Area Network (WLAN) link. Communication within the mobile device 160 can be established using a wireless, copper wire, and/or fiber optic connection using any suitable protocol. In one arrangement, the mobile device 160 can communicate with a base receiver using a standard communication protocol such as TDMA, CDMA, GSM, or iDEN. The base receiver, in turn, can connect the mobile device 160 to the Internet over a packet switched link. In one arrangement, the mobile device 160 can download musical notations and present the musical notations on a display of the mobile device. A user can also download music, sound files, or data to practice wind instrument training with the mobile device. The mobile device 160 can also download wind instruments from the network for allowing a user to emulate different wind instrument sounds. An image of a wind instrument can also be downloaded to the mobile device and displayed on the display 110 when the user selects the wind instrument.

The mobile device 160 can also connect to the Internet over a WLAN. Wireless Local Access Networks (WLANs) provide wireless access to the mobile communication environment 100 within a local geographical area. WLANs can also complement loading on a cellular system, so as to increase capacity. WLANs are typically composed of a cluster of Access Points (APs) also known as base stations. In typical WLAN implementations, the physical layer uses a variety of technologies such as 802.11b or 802.11g WLAN technologies. The physical layer may use infrared, frequency hopping spread spectrum in the 2.4 GHz Band, or direct sequence spread spectrum in the 2.4 GHz Band. The mobile device 160 can send and receive data to a server or other remote servers on the mobile communication environment.

In one arrangement, musicians utilizing a plurality of mobile devices 160 can collaborate together over a cellular network or a WLAN network, such as an ad-hoc network, to perform music together, but are not limited to the WLAN or cellular arrangement. For example, users in an ad-hoc network can use their mobile devices 160 as an ensemble to rehearse together as a band. As one example, the mobile devices 160 can synchronize a playing of a musical notation that scrolls across a display of the mobile devices. That is, each of the users employing the mobile device 160 as a wind instrument can see the same musical notation as it scrolls by on a display The mobile device 160 can sequence musical notations for synchronous display, thereby allowing for collaborative music training, practice, and development.

Figure 2:
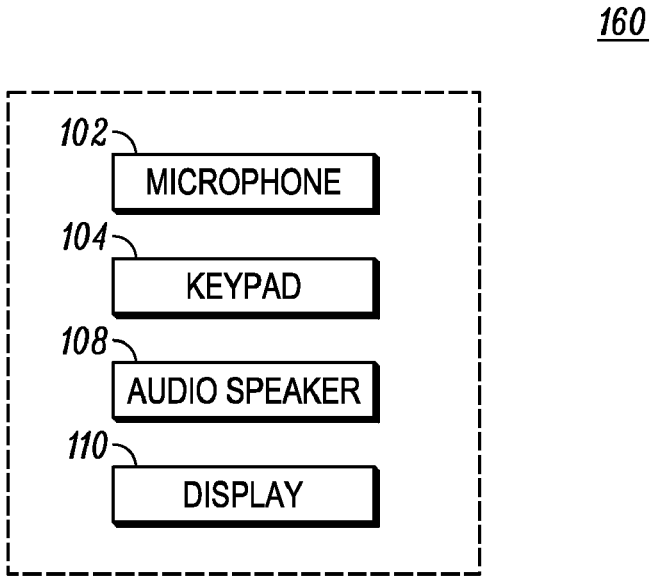
FIG. 2 is a block diagram of the mobile device of FIG. 1 in accordance with the embodiments of the invention.

Referring to FIG. 2, a block diagram of the mobile device 160 suitable for use as a wind instrument is shown. The mobile device 160 can include a microphone 102 for capturing an acoustic signal in response to a blowing action on the microphone 102, a keypad 104 for selecting at least one virtual valve to associate with the acoustic signal, an audio speaker 108 for playing a synthetic musical note of a wind instrument sound, and a display 110 for presenting a musical notation of the synthetic musical note. In practice, one or more keys of the keypad 104 can be pressed during the blowing action on the microphone 102 for producing a synthetic musical note of a wind instrument.

Briefly, the mobile device 160 can function as a valve-operated wind instrument, such as a trumpet. The microphone 102 can emulate a wind instrument aperture for receiving air, and the keys on the keypad 104 can serve as virtual valves for emulating valves on a wind instrument. For example, a user can press one or more keys on the keypad 104 for operating a virtual wind instrument valve. The mobile device can synthesize a wind instrument sound based on the blowing at the microphone 102 and the combination of virtual valves pressed on the keypad 104.

Figure 3:
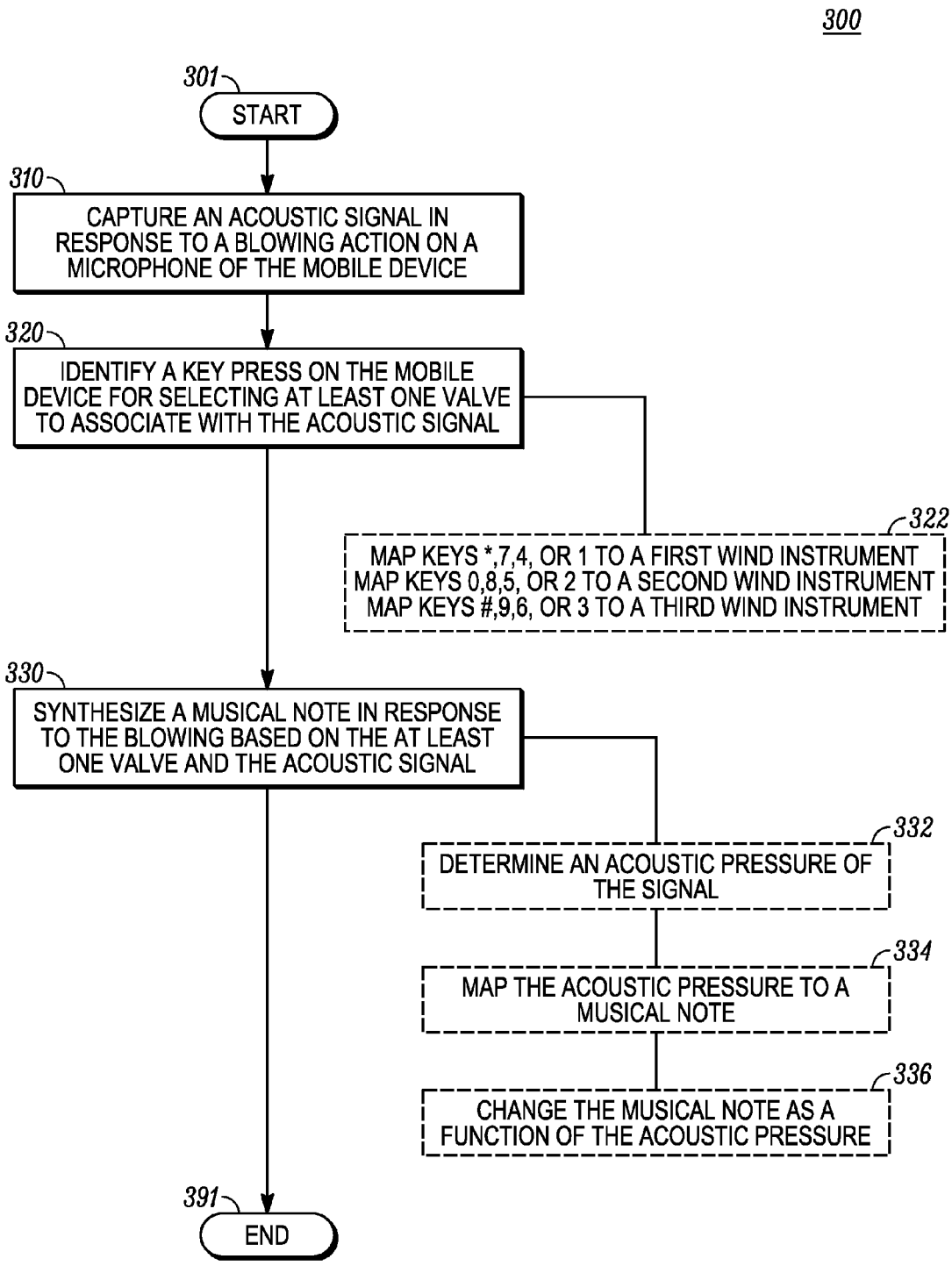
FIG. 3 is a method for producing wind instrument sounds from the mobile device of FIG. 1 in accordance with the embodiments of the invention.

Referring to FIG. 3, a method for producing wind instrument musical sounds from the mobile device 160 is shown. The method 300 can be practiced with more or less than the number of steps shown. To describe the method 300, reference will be made to FIGS. 1, 2, 4, 5 and 6, although it is understood that the method 300 can be implemented in any other suitable device or system using other suitable components. Moreover, the method 300 is not limited to the order in which the steps are listed in the method 300 In addition, the method 300 can contain a greater or a fewer number of steps than those shown in FIG. 3.

At step 301 the method can start. The method can start in a state wherein a user orients the phone as a wind instrument. In particular, an orientation of the mobile device 160 allows the keys on the keypad 104 to be used similarly as valves on a wind instrument. For example, referring to FIG. 1, the users can hold the mobile device 160 similar to a position used in holding a wind instrument, such as a trumpet. The alignment of the keys project ahead with respect to the handling of the mobile device 160 similarly to the placement of valves on a trumpet. A user can curl the fingers over the mobile device 160 to actuate at least one virtual valve by pressing a key on the keypad. The user can simultaneously blow into the microphone for producing air turbulence.

At step 310, an acoustic signal can be captured in response to a blowing action of the user on the microphone of the mobile device. For example, referring to FIG. 1, the user can blow into the microphone 102 to generate air turbulence. At step 320, a key press on a virtual valve (e.g. key on the keypad 104) can be identified for selecting at least one valve to associate with the acoustic signal. For example, a user can press a key to synthesize a wind instrument sound. The synthetic musical note produced is a function of the valve selected by the key, and the blowing action on the microphone 102.

Briefly, referring to FIG. 4, a first valve to finger mapping 400 is shown. The mapping 400 reveals a mapping between keys on the keypad 104 and the corresponding valves. In particular, the valve to finger mapping employs the center column keys of the keypad 104. For example, pressing the "0" key corresponds to pressing valve "1", pressing the "8" key corresponds to pressing valve "2", pressing the "5" key corresponds to pressing valve "2", pressing the "2" key corresponds to pressing valve "4". In one aspect, valve "4" may be optional. That is, some wind instruments do not support more that three valves. In general, a standard keypad can include the alpha-numeric characters *, 0, #, 7, 8, 9, 4, 5, 6, 1, 2, and 3 arranged in a standard presentation format. When the user holds the phone in an orientation for use as a wind instrument. The keys line up naturally with the user's finger positioning.

Briefly, referring to FIG. 5, a second key to valve mapping 500 is shown for allowing the mobile device 160 to produce sounds for up to three wind instruments simultaneously. In particular, three column of the keypad 104 are mapped to three separate wind instruments in accordance with method step 322 (See FIG. 3). For example, each key of a column of they keypad 104 can employed to product a different wind instrument sound (e.g. synthetic musical note). For example, column 1 having keys *, 7, 4, and 1, can correspond to valves 1, 2, 3, and 4 on a first wind instrument. Column 2 having keys 0, 8, 5, and 2 can correspond to valves 1, 2, 3, and 4 on a second wind instrument. Column 4 having keys #, 9, 6, and 3 can correspond to valves 1, 2, 3, and 4 on a third wind instrument. Notably, the column format of the keypad 110 allows the user to play up to three wind instruments simultaneously. The key to valve mappings of FIG. 3 and FIG. 4 identify the association with keys on the keypad 104 of the mobile device 160 and the corresponding valves. This example is recited in method step 322 of FIG. 3.

In one arrangement, a pressing of a single key can determine both a wind instrument and the musical note. In another arrangement, a pressing of multiple keys can generate simultaneous musical notes from separate wind instruments. For example, a user can play three wind instruments simultaneously by selecting virtual valves (i.e. keys on the keypad 104) from three different columns. A first column of keys may correspond to a tuba, a second of keys may correspond to a trumpet, and a third column of keys may correspond to a flugel horn. The user can simultaneously play the three wind instruments by selected fingering of the virtual valves on the keypad 104.

Referring back to method 300 of FIG. 3, at step 330, a musical note can be synthesized in response to the blowing based on the at least one valve and the acoustic signal. That is, the mobile device 160 can produce a wind instrument sound based on the blowing at the microphone 102 (See FIG. 1), and a key press corresponding to a virtual valve. Notably, blowing into the microphone 102 with varying force while pushing none, one, or more of the keypad keys can be mapped directly to sound samples, MIDI notes, or acoustically modeled sounds. For example, at step 332, an acoustic pressure of the acoustic signal captured at the microphone 102 can be determined. At step 334, the acoustic pressure can be mapped to a musical note. At step 336, the musical note can be changed as a function of the acoustic pressure. At step 391, the method 300 can end.

Figure 6:
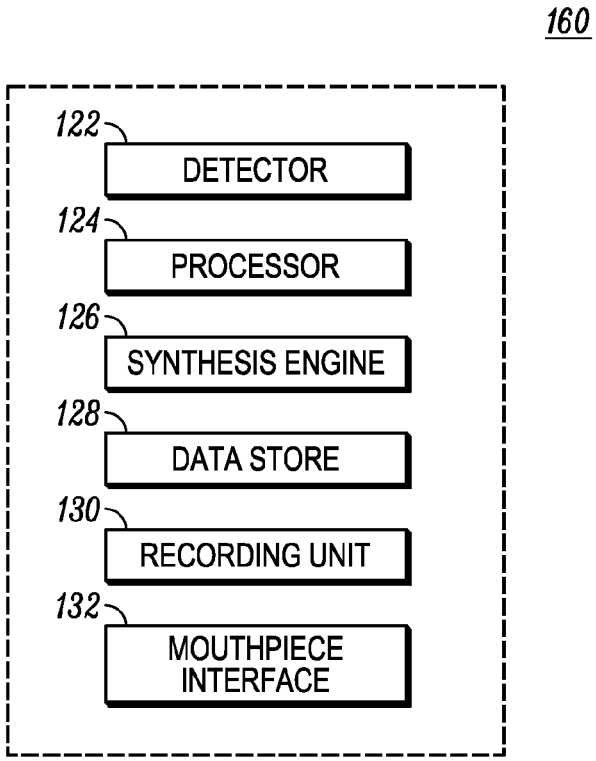
FIG. 6 is another block diagram of the mobile device of FIG. 1 in accordance with the embodiments of the invention.

Briefly, referring to FIG. 6, a block diagram of components for synthesizing wind instrument sound of the mobile device 160 and discussing the method steps 332-336 is shown. Notably, wind instrument sounds can be synthesized as a function of air turbulence resulting from a blowing action on the microphone (102) and a key selection on the keypad 104 that selects a virtual valve. In principle, the virtual valve identifies a length of a tube for passing the air turbulence which produces sound. Understandably, the mobile device 160 emulates the production of sound and does not actually employ tubes of varying lengths. Though, in one arrangement, mathematical models can be employed to synthesize sound based on tube lengths. In another arrangement, sampled waveforms can be employed to synthesize musical notes.

The mobile device 160 can include a detector 122 for determining an acoustic pressure of the air turbulence, a processor 124 for mapping the acoustic pressure to a musical note, and a synthesis engine 126 for producing a musical note in response to the blowing action based on the at least one valve and the air turbulence. The detector 122 can assess a turbulence of the blowing action and assign a measure based on the turbulence. For example, the detector 122 can measure a velocity of the air flow and associate the air flow with a level. Each level can correspond to a production of a musical note, wherein the musical note is based on the valve selected. For instance, if a user presses key "0" for selecting valve 1 (See FIG. 4 or 5), the processor 124 can associate one of a plurality of levels with the valve 1. If the user blows softly, a first level may be detected and associated with a first musical note. As the user blows harder, a velocity of the air increases, and accordingly the detector assigns a higher level to the blowing action. If the user blows hard, a second level can be detected and associated with a second musical note. Notably, levels can be assigned as a function of the air velocity and the musical notes assigned to the virtual valves (e.g. keys on the keypad 104). Furthermore, users can define their own horns by mapping an instrument, key and pressure value for each note.

The processor 124 can change the musical note produced as a function of the acoustic pressure, wherein the function is based on at least one threshold such that the at least one musical note changes if the acoustic pressure exceeds the at least one threshold. For example, each key to valve mapping may have more than one level assigned to the valve. For example, valve 1 may have 3 levels corresponding to the three notes: A, A#, B. Valve 2, may have 4 levels corresponding to the four notes: C, C#, and D. Valve 3, may have 3 levels corresponding to the three notes: E, F, and G. The detector 122 can detect an air velocity and assign a level corresponding to the air pressure. The processor 124 can compare the level to one or more thresholds stored in a memory to determine whether the blowing actions corresponds to a note. For example, a level exceeding a threshold can be associated with a musical note corresponding to the last exceeded threshold. For example, each valve may have three thresholds with each threshold associated with a note. A blowing action that results in a level that exceeds a threshold can be associated with the corresponding musical note. The last exceeded threshold can correspond to the musical note. Notably, the key to valve mappings are software configurable and a user can adjust the musical notations accordingly. In general, the key to valve mappings reference a standard valve to note mapping on a wind instrument.

The processor 124 can also assess a consistency of the blowing action based on an acoustic pressure of the air turbulence captured at the microphone. The processor 124 can display a measure of the consistency on the display 110 for informing a user of their breath control. For example, an experienced wind instrument player can produce a blowing action with constant velocity to sustain a note. The constant velocity keeps the turbulence from varying thereby preserving the note. That is, the note does not change. The processor 124 can present breath control information to the display 110 (See FIG. 2). The display 110 allows the user to receive visual feedback regrading his or her breath control.

Figure 7:
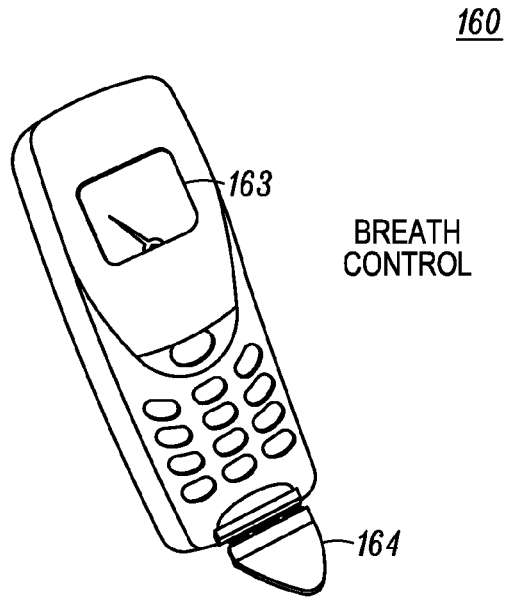
FIG. 7 is in an illustration of the mobile device of FIG. 1 with a mouthpiece attachment accordance with the embodiments of the invention.

For example, referring to FIG. 7, the display 110 can present a needle 163 movement to show a variation in air turbulence due to the blowing action. In one arrangement, a mouthpiece 164 can be coupled to the mobile device 160 for providing a more realistic experience. The mouth piece 164 can be an accessory which connects to the mobile device 160 through a mouthpiece interface 132. The mouthpiece 164 may include hardware or software components for converting a blowing action into a musical note, though is not limited to such. As one example, the mouthpiece 164 may convey parameters of a musical note to the mobile device 160 through the mouthpiece interface 132. For example, the mouthpiece 164 may identify a pitch of a musical note (e.g. A, A#, B, etc), a duration of the musical note, a volume, an articulation, an effect, or any other such suitable music parameter. The parameters can be encapsulated in a data format which is passed to the synthesis engine 126 through the mouthpiece interface 132. The synthesis engine 126 can produce the musical note from the parameters generated by the mouthpiece 164.

Referring back to FIG. 6, the detector 122 can also determine a duration of the blowing action on the microphone. The processor 124 can hold the musical note produced during the duration. For example, a user can sustain a musical note by prolonging the blowing action. The user can shorten the length of a synthetic musical note by terminating the blowing action early. The processor 124 can sustain the synthetic musical note in accordance with the duration of the blowing action. The mobile device 160 can also include a recording unit 130 for saving musical notes produced by the synthesis engine 126. The recording unit 130 can also save musical notations associated with the production of the musical note. For example, during training, a user may play music from a musical notation presented on the display 110 (See FIG. 2). The recording unit 130 can save the musical notes produced and the corresponding musical notation to the data store 128. The data store can be a memory on the local mobile device 160 or on a web server on the Internet. The recording unit 130 can save data associated with wind instrument sound synthesis for later retrieval. The data can be further used for mixing or other functions. This allows a user to replay previous wind instrument practice sessions. Moreover, the recording unit 130 can store collaborative music sessions when the wind instrument is used in conjunction with a plurality of other mobile devices 160.

Figure 8:
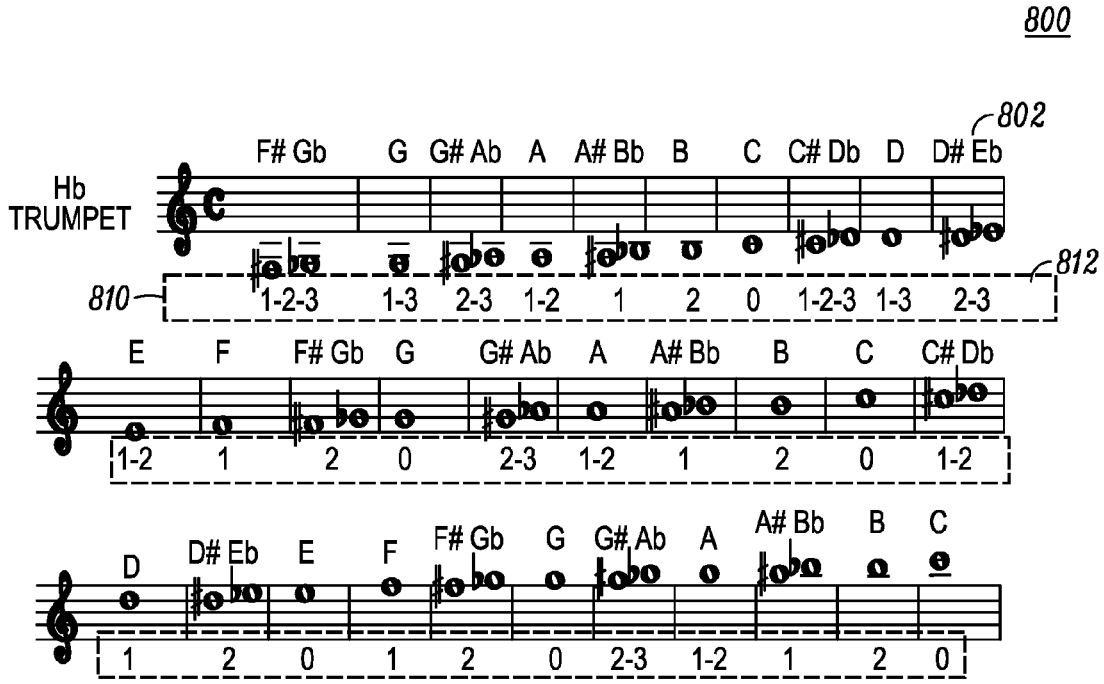
FIG. 8 is a musical notation and fingering chart in accordance with the embodiments of the invention.

Referring to FIG. 8, an exemplary musical notation 800 is shown. In particular, the musical notation 800 includes a fingering chart 810. That is, each note in the musical notation 800 can be associated with a key press (e.g. finger action) on the mobile device 160. For example, note D# 802 in the musical notation 800 can include fingering notation 2-3 (812) in the fingering chart 812. In this case, the note D# on the musical scale corresponds to the simultaneous pressing of key 2 followed by key 3 on the keypad 104 (See FIG. 2) of the mobile device. Each entry on the fingereing chart 812 represents a single note—not a sequence As the fingering chart 810 shows, a note (802) produced by a wind instrument, such as a trumpet, is a combination of which valves (812) are held down and how hard the player blows into the mouthpiece. In such an instrument, 3 and sometimes 4 valves (e.g. keys of the keypad 104) are lined up in a row approximately perpendicular to the performer when the horn is brought into playing position. When a user holds up the mobile device 160 to the user's mouth in a similar position, such as in FIG. 1, the same relationship of the microphone and keypad keys is provided. That is, blowing into the microphone 102 (See FIG. 1) with varying force while pushing none, one, or more of the keypad 104 keys in the center column (2, 5, 8, 0) can be mapped (See FIG. 4) directly to sound samples, MIDI notes, or acoustically modeled sounds equivalent to those made by a trumpet or any selected horn. The duration that the player sustains the breath determines the duration of the note.

The mobile device 160 can also be employed to replicate other wind instruments such as the clarinet, the oboe, the flute, and the like. In principle, these wind instruments are played by covering air holes while blowing into the instrument. The mobile device 160 can also associate the virtual valves with covering air holes. For example, the virtual valves, though not emulating valves, can emulate the covering of holes to generate wind instrument sounds. Also, the keypad 104 (See FIG. 2) can provide 12 air holes (3 columns×4 rows) which are mapped to air holes on the wind instrument.

The musical notation 800 allows a user to read music and the fingering chart 810 allows a user to see the corresponding fingering of the musical notes. The musical notation 800 can be presented on the display 110 (See FIG. 2) of the mobile device while the mobile device 160 is operating as a wind instrument. This allows a user to see the musical notation while playing the mobile device 160 as a wind instrument. Moreover, the mobile device 160 can illuminate keys on the keypad associated with the fingering. For example, referring back to FIG. 2, the musical notation 800 can be scrolled on the display 110 and the keys on the keypad 104 can be illuminated to correspond to the fingering. As an example, a backlit keypad can be used for training to drill students in scales and songs. A user can see the keys light up with the associated musical note on the display.

Figure 9:
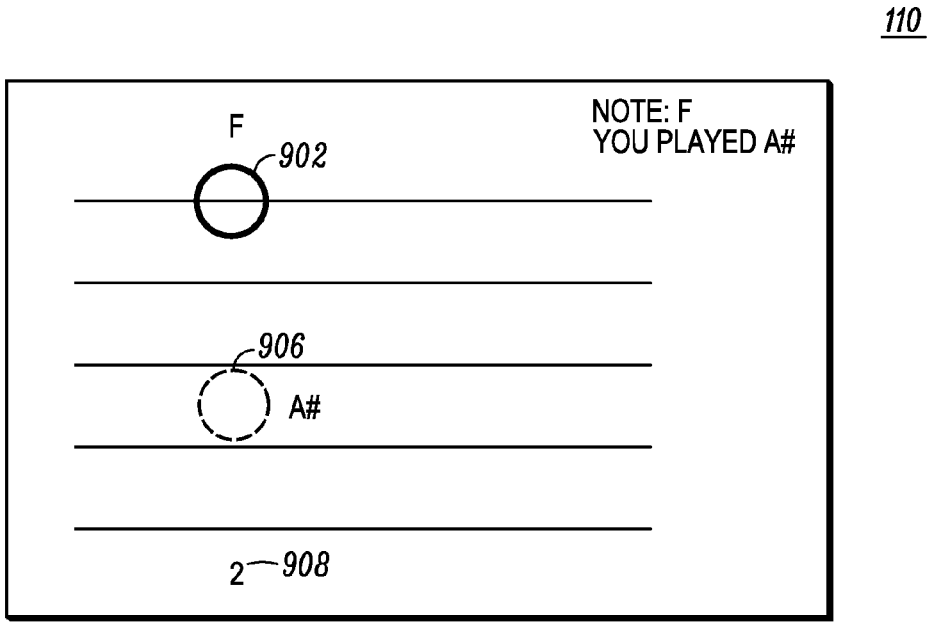
FIG. 9 is presentation of musical notes for wind instrument training in a display of the mobile device of FIG. 1 in accordance with the embodiments of the invention.

For example, referring to FIG. 9, a portion of the musical notation 800 and fingering chart 810 can be presented on the display 110. The user can zoom-in or zoom-out to select how many notes are presented on the display. Graphics on the display 110 can show the note being played on a musical scale, a piece of music to be performed, an image of an actual horn being played, or an indication (e.g. needle movement relative to a center position) of how well the player's breath is controlled.

Furthermore, the display 110 can present the musical note generated by the user for comparison with the actual note. For example, devout musicians may carry the mobile device 160 around for practice instead of an actual wind instrument. Understandably, the mobile device 160 is significantly smaller than an wind instrument such as a tuba or a trumpet. A user can employ the mobile device 160 as a substitute instrument or practice instrument for training. In practice, a user will select a musical notation 800 (See FIG. 8) to present on the display 110 and attempt to play the musical notes corresponding to the musical notation 800. Briefly referring back to FIG. 6, the processor 124 can determine what note was actually played by the user. For example, to generate a musical note, a user should blow sufficiently hard enough to exceed a threshold. The detector 122 can determine the threshold exceeded and the processor 124 can determine the corresponding musical note. The processor 124 can present the corresponding note and associated information on the display 110. For example, referring back to FIG. 9, a user may attempt to play an F note (902), though the blowing action by the user is corresponds to an A# note (906). That is, the note 906 generated as a result of the blowing action is not the intended note 902. A fingering (908) for the note is also presented on the display.

Where applicable, the present embodiments of the invention can be realized in hardware, software or a combination of hardware and software. Any kind of computer system or other apparatus adapted for carrying out the methods described herein are suitable. A typical combination of hardware and software can be a mobile communications device with a computer program that, when being loaded and executed, can control the mobile communications device such that it carries out the methods described herein. Portions of the present method and system may also be embedded in a computer program product, which comprises all the features enabling the implementation of the methods described herein and which when loaded in a computer system, is able to carry out these methods.

While the preferred embodiments of the invention have been illustrated and described, it will be clear that the embodiments of the invention is not so limited. Numerous modifications, changes, variations, substitutions and equivalents will occur to those skilled in the art without departing from the spirit and scope of the present embodiments of the invention as defined by the appended claims.

What is claimed is:

1. A mobile device suitable for use as a wind instrument, comprising:

a microphone of a portable media player for capturing an air turbulence in response to a blowing action on the microphone of the portable media player;

a keypad of the portable media player for selecting at least one virtual valve to associate with the air turbulence;

a synthesis engine for synthesizing a musical note in response to the blowing based on the at least one virtual valve and the air turbulence; and an audio speaker for playing the musical note, wherein one or more keys of the keypad of the portable media player are depressed during the blowing action on the microphone for synthesizing a musical note of a wind instrument.

2. The mobile device of claim 1, further comprising a detector for determining an acoustic pressure of the air turbulence; and a processor for mapping the acoustic pressure to a musical note, wherein one or more keys of the keypad are depressed for changing the musical note in accordance with the acoustic pressure.

3. The mobile device of claim 2, wherein the processor changes the musical note as a function of the acoustic pressure, wherein the function is based on at least one threshold such that the at least one musical note changes if the acoustic pressure exceeds the at least one threshold.

4. The mobile device of claim 1, wherein the detector determines a duration of the air turbulence and the processor holds the musical note for the duration.

5. The mobile device of claim 1, further comprising:

a display for presenting a musical notation of the musical note, wherein the musical notation further identifies a numerical fingering of the at least one virtual valve corresponding to a key on the keypad.

6. The mobile device of claim 1, wherein the keypad further comprises:

at least one back light element for illuminating a key that corresponds to a virtual valve and wherein the mobile device is a cell phone.

7. The mobile device of claim 1, further comprising:

a mouthpiece attachment that couples to the mobile device for associating an acoustic pressure of the blowing action to a virtual valve and determining a musical note for the mobile device to produce.

8. The mobile device of claim 1, wherein the keypad provides a key to virtual valve mapping for three simultaneous instruments, wherein a first wind instrument employs at least one of keys *, 7, 4, or 1, a second wind instrument employs at least one of keys 0, 8, 5, 2, and a third wind instrument employs at least one of keys #, 9, 6, and 3.

9. The mobile device of claim 1, wherein the synthesis engine is a Musical Instrument Device Interface (MIDI) synthesis engine that is Frequency Modulated (FM) generated or Waveform generated and wherein the mobile device is a portable communication device.

10. A method for producing wind instrument musical sounds from a mobile communication device comprising:

capturing an air turbulence in response to a blowing action on a microphone of the mobile communication device;

identifying a key press on the mobile communication device for selecting at least one virtual valve to associate with the air turbulence; and synthesizing a musical note in response to the blowing based on the at least one virtual valve and the air turbulence, wherein one or more keys of the keypad are depressed during the blowing action on the microphone of the mobile communication device for synthesizing a musical note of a wind instrument.

11. The method of claim 10, further comprising:

determining an acoustic pressure of the air turbulence; and mapping the acoustic pressure to a musical note, wherein one or more keys of a keypad are depressed for changing the musical note in accordance with the acoustic pressure, wherein a pressing of a single key can determine both a wind instrument and the musical note, and a pressing of multiple keys generates simultaneous musical note from separate wind instruments.

12. The method of claim 11, further comprising:

changing the musical note as a function of the acoustic pressure of the air turbulence, wherein the function is based on at least one threshold such that the at least one musical note changes if the acoustic pressure exceeds the at least one threshold.

13. The method of claim 11, wherein the mapping further comprises:

generating a modeled sound of at least one wind instrument for emulating a sound of the at least one wind instrument in response to the key press and the blowing action.

14. The method of claim 11, wherein the mapping further comprises:

determining a duration of the air turbulence; and holding the musical note for the duration.

15. The method of claim 11, wherein the mapping associates at least three keys with three virtual valves of a wind instrument.

16. A mobile device suitable for use as a training wind instrument, comprising:

a display for presenting a musical notation and numerical fingering of a musical note;

a back light keypad for illuminating at least one key of the keypad to associate with the musical notation;

a microphone for capturing an air turbulence in response to a blowing action on the microphone;

a synthesis engine for producing a musical note in response to a pressing of an illuminated key and a blowing into the microphone;

an audio speaker for playing the synthetic musical note; and a processor for mapping an acoustic pressure of the air turbulence to a musical note and determining if the blowing action exceeds a threshold for producing a note of the musical notation, and presenting a visual comparison of the musical note and the note for providing training feedback on breath control.

17. The mobile device of claim 16, further comprising:

a mouthpiece attachment that couples to the mobile device for associating an acoustic pressure of the blowing action to an illuminated key and determining a musical note for the mobile device to produce.

18. The mobile device of claim 16, wherein the synthesis engine generates a modeled sound of at least one wind instrument presented as an image on the display, and emulates a sound of the at least one wind instrument in response to the key press and the acoustic pressure.

19. The mobile device of claim 16, further comprising:

a data store for storing musical notations to present on the display as training material; and a recording unit for saving musical note compositions produced in response to a playing of the mobile device as a wind instrument.

20. The mobile device of claim 16, wherein the microphone determines a consistency of the blowing action based on an acoustic pressure of the air turbulence, and the display presents an indication of the consistency for informing a user of a breath control.

* * * * *